US012215707B2

(12) United States Patent
Pyron et al.

(10) Patent No.: US 12,215,707 B2
(45) Date of Patent: Feb. 4, 2025

(54) SACRIFICIAL ANODE ASSEMBLY FOR A SEAL SECTION OF AN ELECTRIC SUBMERSIBLE PUMP (ESP) ASSEMBLY

(71) Applicant: Halliburton Energy Services, Inc., Houston, TX (US)

(72) Inventors: Steven Pyron, Tulsa, OK (US); Matthew Thomas King, Denver, CO (US); Jeffrey Frey, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 128 days.

(21) Appl. No.: 18/101,326

(22) Filed: Jan. 25, 2023

(65) Prior Publication Data

US 2024/0247660 A1 Jul. 25, 2024

(51) Int. Cl.

| | |
|---|---|
| ***F04D 29/10*** | (2006.01) |
| ***E21B 43/12*** | (2006.01) |
| ***F04D 13/08*** | (2006.01) |

(52) U.S. Cl.

CPC ..... *F04D 29/106* (2013.01); *E21B 43/128* (2013.01); *F04D 13/086* (2013.01)

(58) Field of Classification Search

CPC ..... F04D 29/106; F04D 13/086; F04D 13/10; F04D 29/708; E21B 43/128; E21B 41/02

See application file for complete search history.

(56) References Cited

U.S. PATENT DOCUMENTS

| | | | | |
|---|---|---|---|---|
| 4,211,625 A * | 7/1980 | Vandevier | C23F 13/02 204/196.05 |
| 5,622,222 A * | 4/1997 | Wilson | E21B 41/02 166/105.4 |
| 2021/0277761 A1 | 9/2021 | Tiwari | |
| 2022/0341305 A1 | 10/2022 | Bayyouk et al. | |

FOREIGN PATENT DOCUMENTS

| | | |
|---|---|---|
| EP | 1120644 A1 | 8/2001 |
| EP | 1660776 B1 | 6/2007 |

OTHER PUBLICATIONS

Foreign Communication from Related Application—International Search Report and Written Opinion of the International Searching Authority, International Application No. PCT/US2023/011820, Oct. 18, 2023, 9 pages.

* cited by examiner

*Primary Examiner* — Bryan M Lettman
(74) *Attorney, Agent, or Firm* — Conley Rose, P.C.; Rodney B. Carroll

(57) ABSTRACT

An electric submersible pump (ESP) assembly. The ESP assembly comprises a seal section that comprises a housing and at least one sacrificial anode assembly. The at least one sacrificial anode assembly comprises a sacrificial material suitable to attenuate the corrosive effect of $H_2S$ fluid (hydrogen sulfide) and comprises a containment disposed inside the housing. The containment defines an annulus between an outside of the containment and an inside of the housing. The containment is disposed around the sacrificial material. The (Continued)

containment defines interiorly an initially void space downhole of the sacrificial material. The at least one sacrificial anode assembly defines a folded fluid flow path through the sacrificial material.

16 Claims, 7 Drawing Sheets

SACRIFICIAL ANODE ASSEMBLY FOR A SEAL SECTION OF AN ELECTRIC SUBMERSIBLE PUMP (ESP) ASSEMBLY

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Electric submersible pumps (hereafter "ESP" or "ESPs") may be used to lift well fluid in a wellbore. Specifically, ESPs may be used to pump the well fluid to the surface in wells with low reservoir pressure. ESPs may be of importance in wells having low bottomhole pressure or for use with well fluids having a low gas/oil ratio, a low bubble point, a high water cut, and/or a low API gravity. Moreover, ESPs may also be used in any production operation to increase the flow rate of the well fluid to a target flow rate.

Generally, an ESP comprises an electric motor, a seal section, a pump intake, and one or more pumps (e.g., a centrifugal pump). These components may all be connected with a series of shafts and couplings. For example, the pump shaft may be coupled to the motor shaft through the intake and seal shafts. An electric power cable provides electric power to the electric motor from the surface. The electric motor supplies mechanical torque to the shafts, which provide mechanical power to the pump. Well fluids may enter the wellbore where they may flow past the outside of the motor to the pump intake. These well fluids may then be produced by being pumped to the surface inside the production tubing via the pump, which discharges the well fluids into the production tubing. The well fluids that enter the ESP may sometimes comprise corrosive fluids such as hydrogen sulfide ($H_2S$) gas that may infiltrate the seal section and cause damage to the electric motor.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
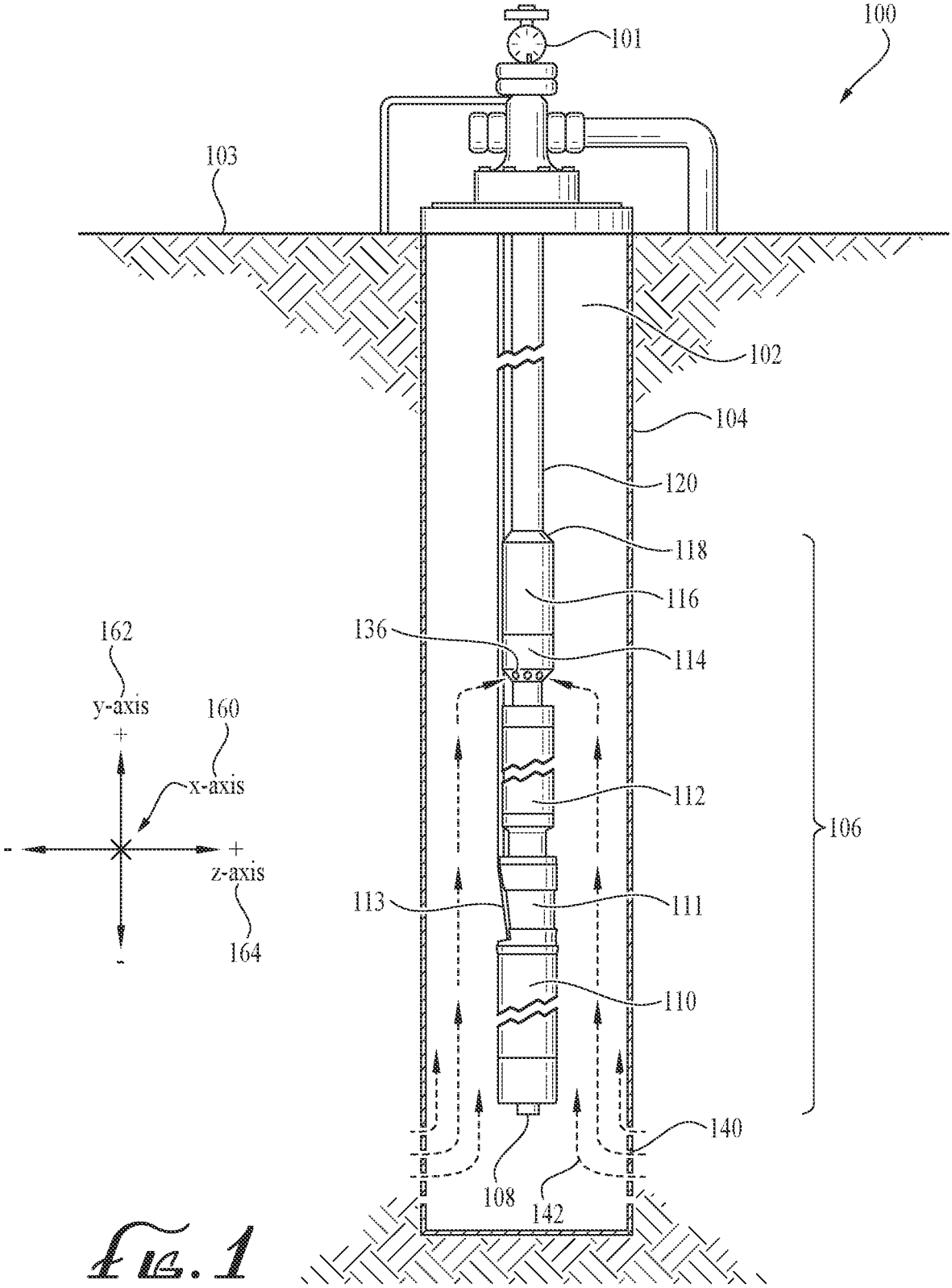
FIG. 1 is an illustration of a completion string disposed in a wellbore according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "upstream," "downstream," "up," and "down" are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid. "Down" is directed counter to the direction of flow of well fluid, towards the source of well fluid. "Up" is directed in the direction of flow of well fluid, away from the source of well fluid. As used herein, the term "about" when referring to a measured value or fraction means a range of values +/−5% of the nominal value stated. Thus, "about 1 inch," in this sense of "about," means the range 0.95 inches to 1.05 inches, and "about 5000 PSI," in this sense of "about," means the range 4750 PSI to 5250 PSI. Thus, the fraction "about $^{8}/_{10}$s" means the range $^{76}/_{100}$s to $^{84}/_{100}$s.

The present disclosure teaches a novel seal section of a completion string that incorporates at least one sacrificial anode assembly. In wellbores that produce hydrogen sulfide ($H_2S$) gas, use of this novel seal section can protect completion string components from the deleterious effects of $H_2S$ gas and extend the operation life of the completion string. For example, when an electric motor is coupled to this novel seal section, $H_2S$ gas that might otherwise infiltrate a conventional seal section and attach copper components of the electric motor may react with a sacrificial anode body within the sacrificial anode assembly, neutralizing and/or attenuating the corrosive action of the $H_2S$ gas.

In an embodiment, a sacrificial anode assembly comprises a sacrificial anode body disposed inside of a containment structure. In a first flow state, the flow of fluid in the sacrificial anode assembly is in through a first port at an uphole end of the sacrificial anode assembly, downhole within the sacrificial anode assembly, uphole within the sacrificial anode assembly, and out through a second port near the uphole end of the containment structure. In a second flow state, the fluid flows in the reverse direction: in through the second port near the uphole end of the containment structure, downhole within the sacrificial anode assembly, uphole within the sacrificial anode assembly, and out through the first port at the uphole end of the sacrificial anode assembly. Both of these fluid paths may be referred to as a folded fluid path because the direction of fluid flow reverses direction within the sacrificial anode assembly. This folded fluid path desirably increases the contact between the fluid and the sacrificial anode body. When the fluid includes $H_2S$ gas, the increased contact between the fluid and the sacrificial anode body increases the reaction between the $H_2S$ gas and promotes more complete neutralization of the corrosive effects of the $H_2S$ gas.

The folded fluid path may also be referred to as a tortuous fluid path. In an embodiment, the fluid path through the sacrificial anode assembly may be more tortuous and may reverse directions more than one time, for example reversing direction three times, reversing direction five times, reversing direction seven times, or reversing direction some other number of times less than 2000 times. In an embodiment, the form of the sacrificial anode body defines a first helical path in a first portion of the fluid flow path and a second helical path in a second portion of the fluid path that contributes to increasing the length of the folded fluid path and increases the surface area of the sacrificial anode body exposed to the fluid.

In an embodiment, the sacrificial anode body is a unitary structure or a monolithic structure. The material of the sacrificial anode body comprises reactive material such as copper, bronze, aluminum, zinc, or other materials that react with $H_2S$ gas in a way to corrode and disintegrate the sacrificial anode body while neutralizing the corrosive effects of the $H_2S$ gas, thereby reducing downstream deterioration of other components of the completion assembly, such as reducing deterioration and damage to copper components of an electric motor. In an embodiment, the sacrificial anode body may be machined into a geometry that defines a plurality of fluid paths—for example a plurality of helical paths—that increases the surface area of the sacrificial anode body exposed to the fluid relative to the mass of the sacrificial material. In an embodiment, the sacrificial anode body may be formed with a tortuous fluid pathway by a casting process. In an embodiment, the sacrificial anode body may be formed with a tortuous fluid pathway by a 3-D printing process. In an embodiment, the sacrificial anode body comprises a plurality of different sized spheres and/or particles that are retained within different pathways within the sacrificial anode assembly by bulkheads within the containment structure and by the inside of the containment structure.

The containment structure defines a void space at an interior downhole end that is configured to capture and retain debris that sloughs off of the surfaces of the sacrificial anode body over time as $H_2S$ gas progressively consumes and breaks down the sacrificial material. This debris remains in the void space and does not circulate upwards to exit the containment structure. This prevents the debris propagating into bearings and shaft seals inside the seal section that otherwise might shorten the service life of the seal section.

Turning now to FIG. 1 a well site environment 100 showing a completion string disposed in a wellbore, according to one or more aspects of the disclosure, is described. The well site environment 100 comprises a wellbore 102 that is at least partially cased with casing 104. As depicted in FIG. 1, the wellbore 102 is substantially vertical, but the electric submersible pump (ESP) assembly 106 described herein also may be used in a wellbore 102 that has a deviated or horizontal portion. The well site environment 100 may be at an on-shore location or at an off-shore location. The ESP assembly 106 in an embodiment comprises an optional sensor package 108, an electric motor 110, a motor head 111 that couples the electric motor 110 to a seal unit 112, a fluid intake 114 having inlet ports 136, and a pump assembly 116. In an embodiment, the pump assembly 116 is a centrifugal pump assembly that comprises a plurality of centrifugal pump stages, each centrifugal pump stage comprising an impeller coupled to a drive shaft of the centrifugal pump assembly and a diffuser retained stationary by a housing of the centrifugal pump assembly. In an embodiment, the pump assembly 116. The drive shaft of the centrifugal pump assembly may be turned by a drive shaft of the electric motor 110 via a drive shaft of the seal section 112 or via a drive shaft of an optional gas separator. The drive shaft of the seal section 112 may be turned by the drive shaft of the electric motor. The drive shaft of the optional gas separator may be turned by the drive shaft of the seal section 112. In an embodiment, the pump assembly 116 is a progressive cavity pump that may be turned by a drive shaft coupled to a drive shaft of the electric motor 110 via the drive shaft of the seal section 112 or via the drive shaft of an optional gas separator. In an embodiment,?

In an embodiment, the electric motor 110 may be replaced by a hydraulic turbine, a pneumatic turbine, a hydraulic motor, or an air motor, and in this case the assembly 106 may be referred to as a submersible pump assembly. In an embodiment, the ESP assembly 106 may further comprise a gas separator assembly (not shown) that may be located between the fluid intake 114 and the pump assembly 116. In an embodiment, the fluid intake 114 may be integrated into a downhole end of the optional gas separator. In an embodiment, the fluid intake 114 may be integrated into a downhole end of the pump assembly 116.

The pump assembly 116 may couple to a production tubing 120 via a connector 118. An electric cable 113 may attach to the electric motor 110 and extend to the surface 103 to connect to an electric power source. In an embodiment, where the electric motor 110 is replaced by a hydraulic turbine or a hydraulic motor, the electric cable 113 may be replaced by a hydraulic power supply line. In an embodiment, where the electric motor 110 is replaced by a pneumatic turbine or an air motor, the electric cable 113 may be replaced by a pneumatic power supply line. The casing 104 and/or wellbore 102 may have perforations 140 that allow well fluid 142 to pass from the subterranean formation through the perforations 140 and into the wellbore 102. In some contexts, well fluid 142 may be referred to as reservoir fluid.

It will be appreciated that in a different embodiment, the configuration of the ESP assembly 106 may be different. For example, in a through-tubing-conveyed completion, the order of placement of components of the ESP assembly 106 may be altered in various ways, for example with the fluid intake located at the downhole end of the ESP assembly 106, the pump assembly 116 located uphole of the fluid intake 114, the seal section 112 located uphole of the pump assembly 116, and the motor 110 located uphole of the seal section 112. It is understood that the novel high volume, axial flow centrifugal pump stage disclosed herein can be used to advantage in any of these alternative configurations of the ESP assembly 106.

The well fluid 142 may flow uphole in the wellbore 102 towards the ESP assembly 106, in the inlet ports 136, and into the fluid intake 114. The well fluid 142 may comprise a liquid phase fluid. The well fluid 142 may comprise a gas phase fluid mixed with a liquid phase fluid. The well fluid 142 may comprise $H_2S$ gas. Under normal operating conditions (e.g., well fluid 142 is flowing out of the perforations 140, the ESP assembly 106 is energized by electric power, the electric motor 110 is turning, and a gas slug is not present at the ESP assembly 106), the well fluid 142 enters the inlet ports 136 of the fluid intake 114, flows into the pump assembly 116, and the pump assembly 116 flows the fluid through the connector 118 and up the production tubing 120 to a wellhead 101 at the surface 103. The pump assembly 116 provides pumping pressure or pump head to lift the well fluid 142 to the surface. The well fluid 142 may comprise hydrocarbons such as crude oil and/or natural gas. The well fluid 142 may comprise water. In a geothermal application, the well fluid 142 may comprise hot water. An orientation of the wellbore 102 and the ESP assembly 106 is illustrated in FIG. 1 by an x-axis 160, a y-axis 162, and a z-axis 164.

Figure 2:
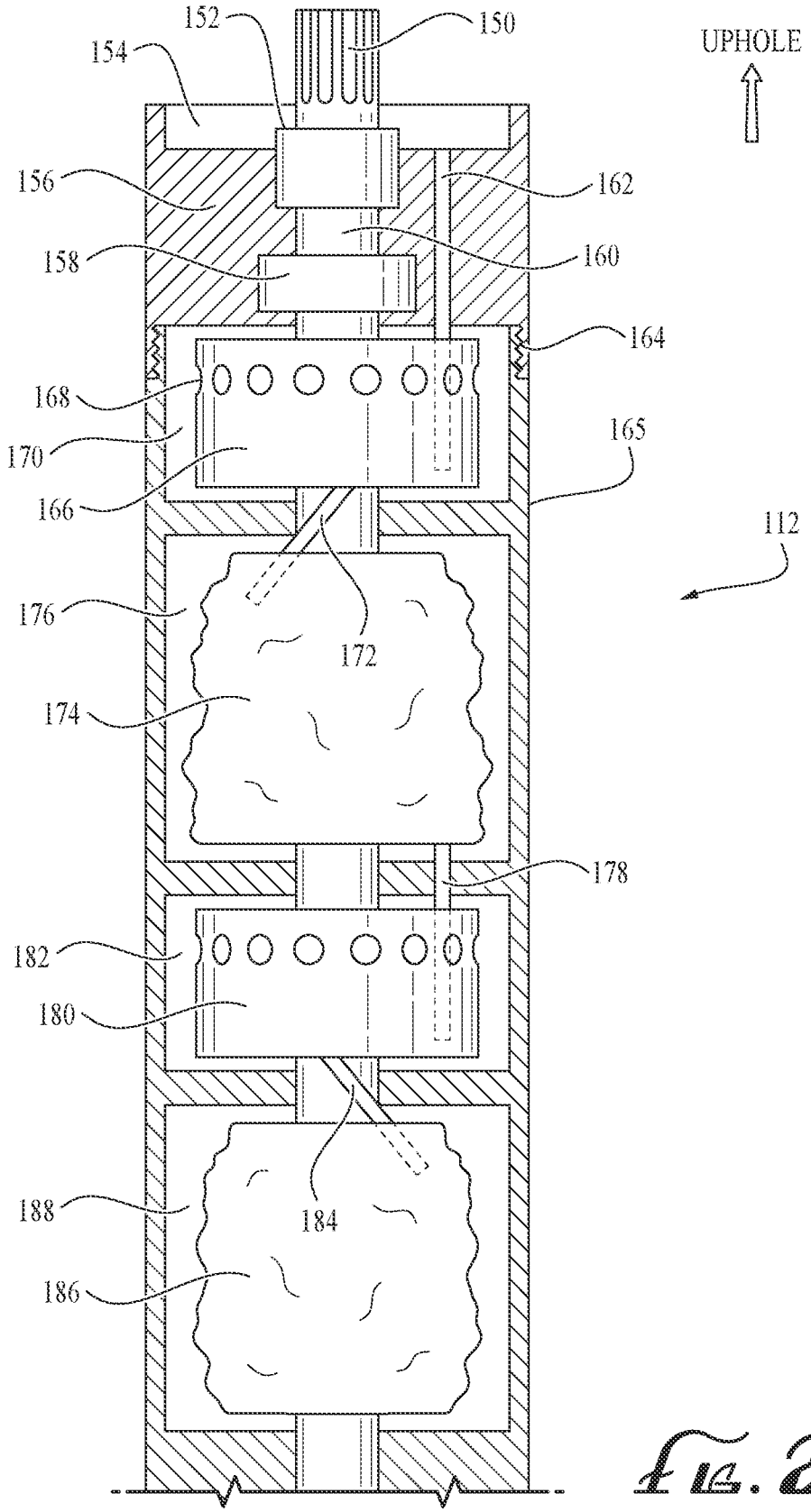
FIG. 2 is an illustration of an upper portion of a seal section according to an embodiment of the disclosure.

Turning now to FIG. 2, an upper portion of the seal section 112 is described. In an embodiment, the seal section 112 comprises a drive shaft 160 having a plurality of male splines 150 at an uphole end that are suitable for mating to a drive shaft in the pump assembly 116 or to a drive shaft in a gas separator uphole of the seal section 112. The coupling between the drive shaft 160 of the seal section 112 and the drive shaft located uphole may be accomplished by a coupling shell that interiorly defines female splines that mate with the male splines 150 and corresponding male splines at the downhole end of the drive shaft located uphole (e.g., the drive shaft in the pump assembly 116 or the drive shaft in the gas separator).

A head 156 of the seal section 112 may couple to the fluid intake 114, for example via bolts or another connecting mechanism. The head 156 defines a head cavity 154 that is open to the interior of the fluid intake 114 and hence is fluidically coupled to the wellbore 102. A shaft seal 152 is provided between the drive shaft 160 and an aperture defined by the head 156 that desirably prevents well fluid 142 entering between the head 156 and the drive shaft 160. A radial bearing 158 is retained by the head 156 or a downhole portion of the seal section 112. The radial bearing 158 radially stabilizes the drive shaft 160. One or more additional radial bearing (not shown) may be disposed downhole within the seal section 112.

The head 156 may couple to a housing 165 of the seal section 112, for example by a threaded coupling 164 or by another coupling mechanism. The housing 165 retains a first sacrificial anode assembly 166 disposed near an uphole end of the seal section 112. A breather tube 162 extends from the head cavity 154 to an interior of the first sacrificial anode assembly 166 and provides fluid communication from the head cavity to the interior of the first sacrificial anode assembly 166. In an embodiment, a first interior chamber 170 of the seal section 112 surrounds the first sacrificial anode assembly 166 and separates it fluidically from a second interior chamber 176 of the seal section 112 that surrounds a first expansion bladder 174. The first interior chamber 170 provides a pathway for fluid to flow out of a plurality of ports 168 disposed at an uphole end of the first sacrificial anode assembly 166 into the first interior chamber 170 and a pathway for fluid to flow out of the first interior chamber 170 back through the ports 168 into the interior of the first sacrificial anode assembly 166. A first flow tube 172 provides fluid communication between the first interior chamber 170 and an interior of the first expansion bladder 174.

A second sacrificial anode assembly 180 is disposed within the housing 165 downhole of the first expansion bladder 174. In an embodiment, the second sacrificial anode assembly 180 is surrounded by a third interior chamber 182 and separates the second sacrificial anode assembly 180 from the second interior chamber 176 and from a fourth interior chamber 188 that surrounds a second expansion bladder 186 The third interior chamber 182 provides a pathway for fluid to flow out of ports disposed at an uphole end of the second sacrificial anode assembly 180 into the third interior chamber 182 and a pathway for fluid to flow out of the third interior chamber 182 back through the ports into the interior of the second sacrificial anode assembly 180. A third flow tube 178 extends from the interior of the first expansion bladder 174 to an interior of the second sacrificial anode assembly 180 and provides fluid communication between the first expansion bladder 174 and the second sacrificial anode assembly 180.

The seal section 112 may comprise one or more additional sacrificial anode assemblies and an equivalent number of one or more additional expansion bladders disposed within the housing 165 downhole of the components illustrated in FIG. 2. The sacrificial anode assembly disposed uphole of a given expansion bladder may be considered to protect the next downhole expansion bladder from $H_2S$ damage and infiltration, thereby blocking or attenuating infiltration of $H_2S$ gas downhole within the seal section 112 and eventual infiltration into an interior of the electric motor 110.

As the ESP assembly 106 is first run-up to speed in the wellbore 102, dielectric oil within the electric motor 110 and within the seal section 112 is heated and expands. The expansion of the oil causes the expansion bladders within the seal section 112 to expand to their maximum extent, when they will be restrained by the interior chamber in which they are disposed. The expansion of dielectric fluid flows through flow tubes between expansion bladders and uphole sacrificial anodes. Some excess dielectric fluid may be vented out of the first sacrificial anode assembly 166 out the breather tube 162, into the head cavity 154, out the fluid intake 114, and into the wellbore 102. After the initial run-up of the ESP assembly 106, typically no more dielectric fluid is bled off into the wellbore 102. During sequences of ESP assembly 106 turn-off and turn-on, dielectric oil expansion and contraction are managed by expansion and contraction of the expansion bladders.

Over time, $H_2S$ gas can infiltrate the seal section via the breather tube 162 via a diffusion process. $H_2S$ gas can penetrate the elastomeric material of the expansion bladders. The sacrificial anode assemblies 166, 180 scrub out and neutralize at least some of the $H_2S$ gas that diffuses into the seal section 112.

Figure 3:
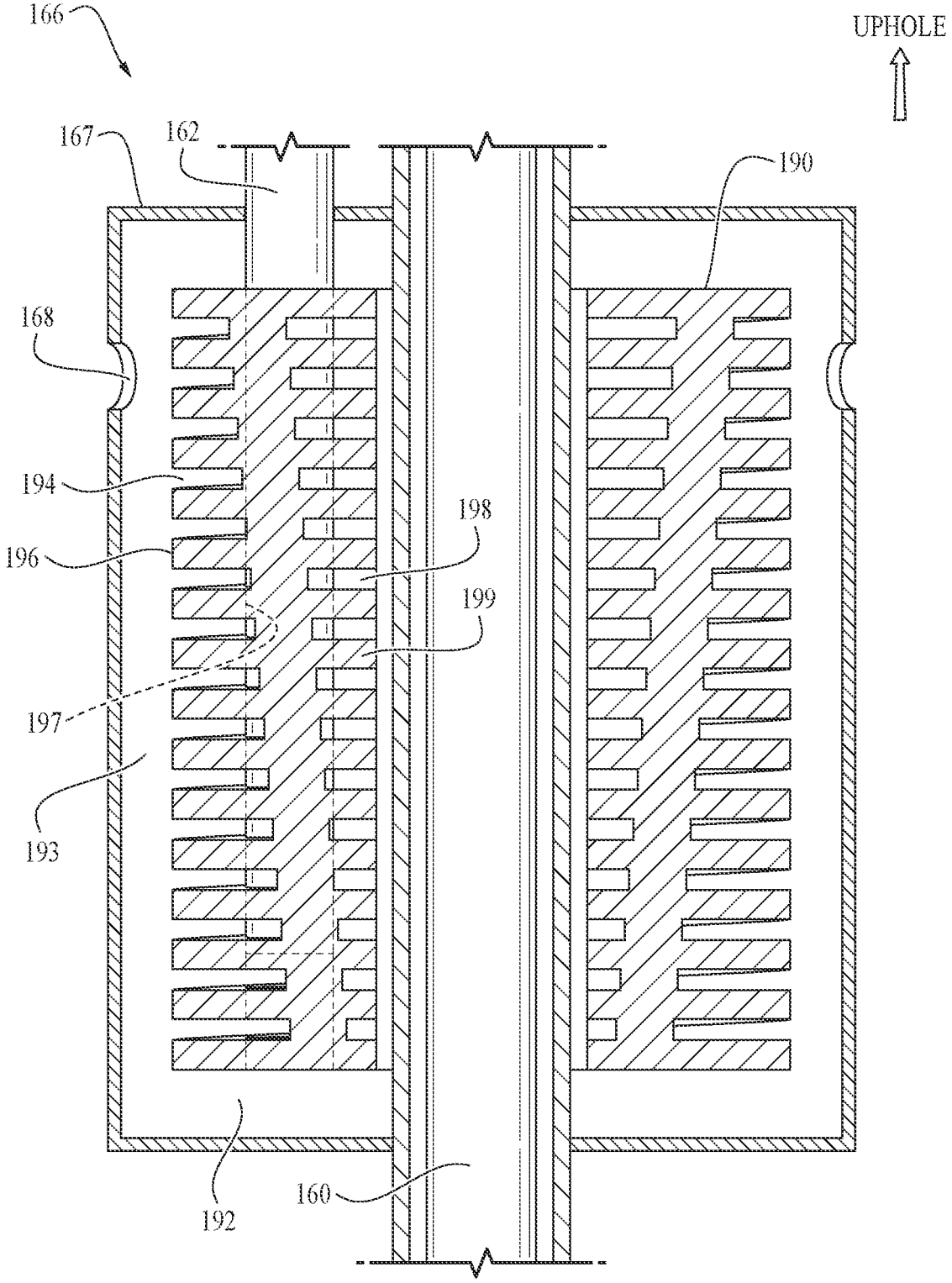
FIG. 3 is an illustration of a sacrificial anode assembly according to an embodiment of the disclosure.

Turning now to FIG. 3, further details of an exemplary sacrificial anode assembly 166 are described. In an embodiment, the sacrificial anode assembly 166 comprises a containment 167 or housing that retains a sacrificial anode body 190. The containment 167 defines a plurality of ports 168 or apertures. The uphole end of the containment 167 may be open or it may be closed and sealed around the breather tube 162, the third flow tube 178, or some other flow tube providing fluid communication between an interior of the containment 167 and of the sacrificial anode body 190 with an expansion bladder or with the head cavity 154.

In an embodiment, fluid (e.g., well fluid 142 or dielectric fluid, depending on where the subject sacrificial anode assembly 166 is disposed within the seal section 112) may flow downhole within the sacrificial anode body 190 to exit out of a bottom of the sacrificial anode body 190. The fluid may then flow uphole within an interior of the sacrificial anode body 190 (e.g., between the drive shaft 160 or a sleeve surrounding the drive shaft 160 and an interior of the sacrificial anode body 190) and flow uphole within an exterior of the sacrificial anode body 190.

In an embodiment, the exterior of the sacrificial anode body 190 defines one or more lands 196 and grooves 194. The grooves 194 may define a helical pathway around the outside of the sacrificial anode body 190 and promote fluid flowing uphole within the grooves 194 following the helical path, thereby following a tortuous path that increases the surface area of the sacrificial anode body 190 that the fluid comes into contact with. This can increase the reaction between $H_2S$ gas and the material of the sacrificial anode body 190. In an embodiment, the lands 196 may seal against an inside of the containment 167, thereby increasing the propensity for the fluid and any $H_2S$ gas to follow the tortuous helical flow path. In another embodiment, however, the lands 196 do not seal against the inside of the containment 167, thereby leaving an annulus 193 providing space for debris generated by reaction of $H_2S$ gas with the sacrificial anode body 190 to fall to the bottom of the containment 167. In some contexts, the grooves 194 and lands 196 may be said to define a rectangular shape in vertical cross-section. When the lands 196 and grooves 194 define a helical pathway round the outside of the sacrificial anode body 190, the one or more lands 196 may be a single land (because the land wraps continually around the sacrificial anode body 190 as an uninterrupted helical land) and the one or more grooves 194 may be a single groove (because the groove wraps continually around the sacrificial anode body 190 as an uninterrupted helical groove).

In an embodiment, the interior of the sacrificial anode body 190 defines one or more lands 199 and grooves 198. The grooves 198 may define a helical pathway around the inside of the sacrificial anode body 190 and promote the fluid flowing uphole within the grooves 198 following the helical path, thereby following a tortuous path that increases the surface area of the sacrificial anode body 190 that the fluid comes into contact with. This can increase the reaction between $H_2S$ gas and the material of the sacrificial anode body 190. In an embodiment, the lands 196 may seal against an inside of a sheath extending around the drive shaft 160, thereby increasing the propensity for the fluid and any $H_2S$ gas to follow the tortuous helical flow path. In another embodiment, however, the lands 199 do not seal against an inside of a sheath extending around the drive shaft 160, thereby leaving space for debris generated by reaction of $H_2S$ gas with the sacrificial anode body 190 to fall to the bottom of the containment 167. In some contexts, the grooves 198 and lands 199 may be said to define a rectangular shape in vertical cross-section. When the lands 199 and grooves 198 define a helical pathway round the inside of the sacrificial anode body 190, the one or more lands 199 may be a single land (because the land wraps continually around the sacrificial anode body 190 as an uninterrupted helical land) and the one or more grooves 198 may be a single groove (because the groove wraps continually around the sacrificial anode body 190 as an uninterrupted helical groove).

In an embodiment, the inflow path from the breather tube 162 or other flow tube may exit at the uphole end of the interior of the sacrificial anode body 190 and be confined to following the grooves 198 to reach the downhole end of the sacrificial anode body 190. In an embodiment, a bore 197 is defined by the sacrificial anode body 190, and the breather tube 162 extends downhole inside of the bore 197. The containment 167 defines a void space 192 at its downhole end. The fluid flowing downhole in the grooves 198 may pass over from an inside location (close to the drive shaft 160) to an outside location (close to the inside vertical wall of the containment 167) via the void space 192. The fluid may then enter the downhole end of the grooves 194 and flow uphole to reach the ports 168 and exit the containment into an interior chamber of the seal section 112.

It is noted that the flow path of fluid downhole within the sacrificial anode body 190—either following the grooves 198 helically downhole or flowing downhole within the breather tube 162 or other flow tube—followed by the flow path of fluid reversing direction and moving uphole to exit the ports 168 may be referred to as a folded fluid path. Additionally, the fluid flow following the grooves 194, 198 in a helical path may be referred to as a folded path. Alternatively, the fluid flow following the grooves 194, 198 in a helical path may be referred to as a helical path. Alternatively, the fluid flow following the grooves 194, 198 may be referred to as a tortuous path.

The void space 192 provides an area for debris that breaks off of the surfaces of the sacrificial anode body 190—for example debris that is shed or sloughed off of the walls of the grooves 194, 198—to fall to the downhole end of the containment 167 and be trapped. In this way, the debris sloughed off of the sacrificial anode body 190 is prevented from flowing out of the ports 168 and prevented from propagating downhole within the seal section 112, thereby avoiding the debris infiltrating seals and bearings, extending the life of the seal section 112.

Figure 4:
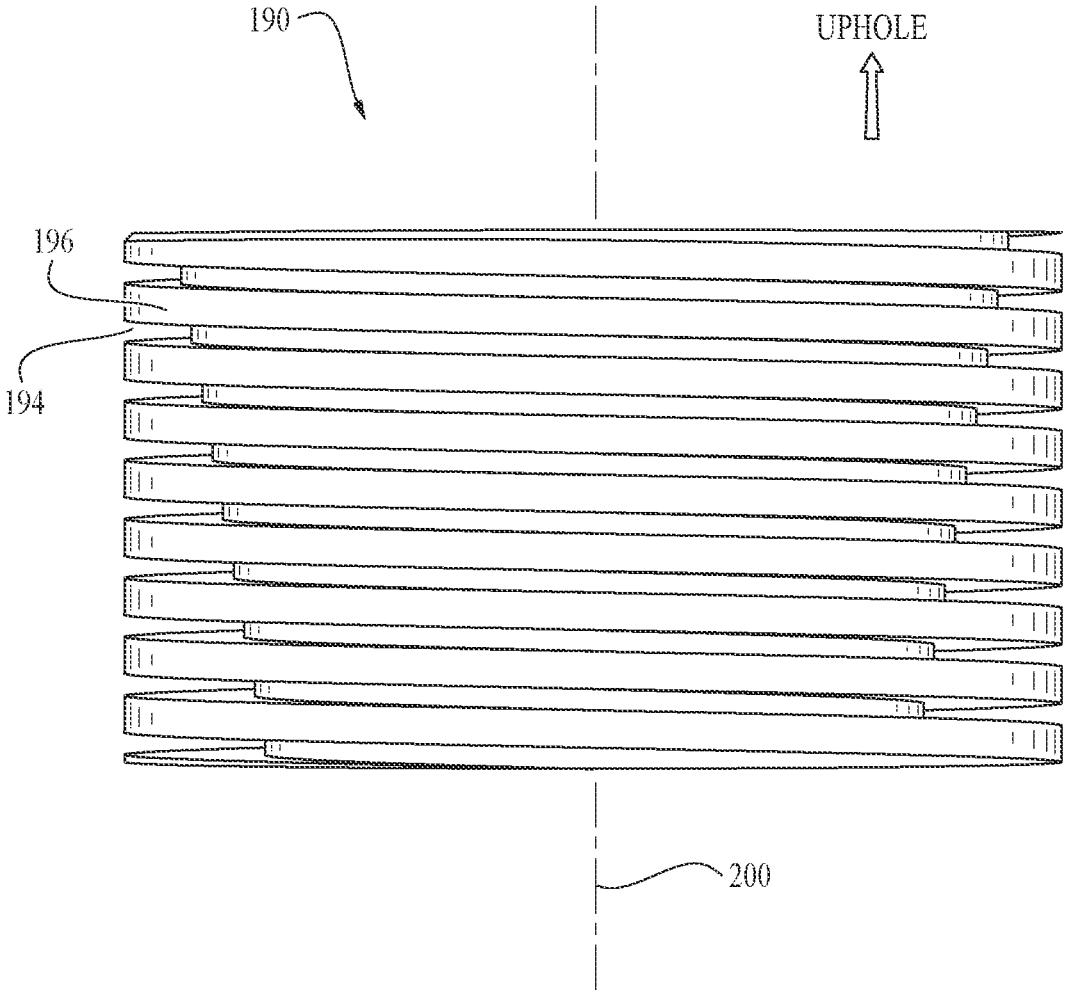
FIG. 4 is an illustration of a sacrificial anode body according to an embodiment to the disclosure.

Turning now to FIG. 4, the sacrificial anode body 190 is shown illustrating the helical structure of the grooves 194 and lands 196. The sacrificial anode body 190 may be machined from a solid piece of material to have the geometry of grooves 194, 198 and lands 196, 199 described above. The sacrificial anode body 190 may be cast in the form described above. The sacrificial anode body 190 may be 3-D printed in the form described above. In an embodiment, the sacrificial anode body 190 may be formed of copper, bronze, aluminum, zinc, or other metals. In an embodiment, at least ninety percent of a mass of the sacrificial anode body 190 is copper, bronze, aluminum, zinc, or a combination of these metals. In an embodiment, at least ninety-five percent and no more than one hundred percent of the mass of the sacrificial anode body 190 is copper, bronze, aluminum, zinc, or a combination of these metals. In an embodiment, at least ninety-seven percent and no more than one hundred percent of the mass of the sacrificial anode body 190 is copper, bronze, aluminum, zinc, or a combination of these metals. In an embodiment, at least ninety-eight percent and no more than one hundred percent of the mass of the sacrificial anode body 190 is copper, bronze, aluminum, zinc, or a combination of these metals. In an embodiment, at least ninety-nine percent and no more than one hundred percent of the mass of the sacrificial anode body 190 is copper, bronze, aluminum, zinc, or a combination of these metals. In an embodiment, one hundred percent of the mass of the sacrificial anode body 190 is copper, bronze, aluminum, zinc, or a combination of these metals.

Figure 5:
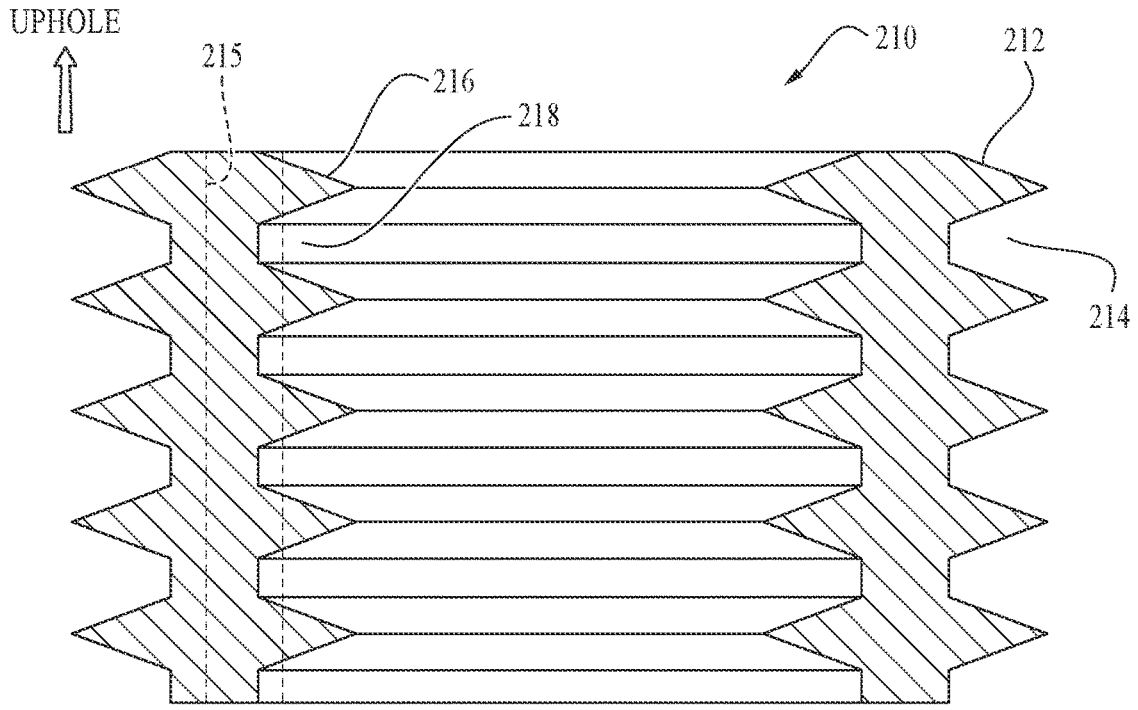
FIG. 5 is an illustration of another sacrificial anode body according to an embodiment of the disclosure.

Turning now to FIG. 5, another embodiment of a sacrificial anode body 210 is described. The sacrificial anode body 210 may be used in the containment 167 described above and is substantially similar to the sacrificial anode body 190 of FIG. 3 and FIG. 4, except that the cross-sectional geometry of the one or more grooves 214 and the one or more lands 212 on an outside of the sacrificial anode body 210 and the one or more grooves 218 and the one or more lands 216 on an inside of the sacrificial anode body 210 differ from those of grooves 194, 198 and lands 196, 199 of sacrificial anode body 190 described above. The lands 212, 216 of sacrificial anode body 210 may promote debris generated by reaction of $H_2S$ gas with the material of the sacrificial anode body 210 more readily sloughing off of the lands 212, 216 and falling to the void area at the downhole end of the containment 167 surrounding the sacrificial anode body 210. The geometry of the grooves 214, 218 and lands 212, 216 may also promote avoiding the grooves 214, 218 becoming encumbered or obstructed by debris that does not slough off. In an embodiment, the sacrificial anode body 210 may define a bore 215 that receives the breather tube 162 that extends downhole inside the bore 215. In an embodiment, the grooves 214 may define a helical flow pathway around an outside of the sacrificial anode body 210 and the grooves 218 may define a helical flow pathway around an inside of the sacrificial anode body 210. In some contexts, the one or more lands 212 and the one or more lands 216 may be said to define a sawtooth shape or a triangular shape in vertical cross-section.

Figure 6:
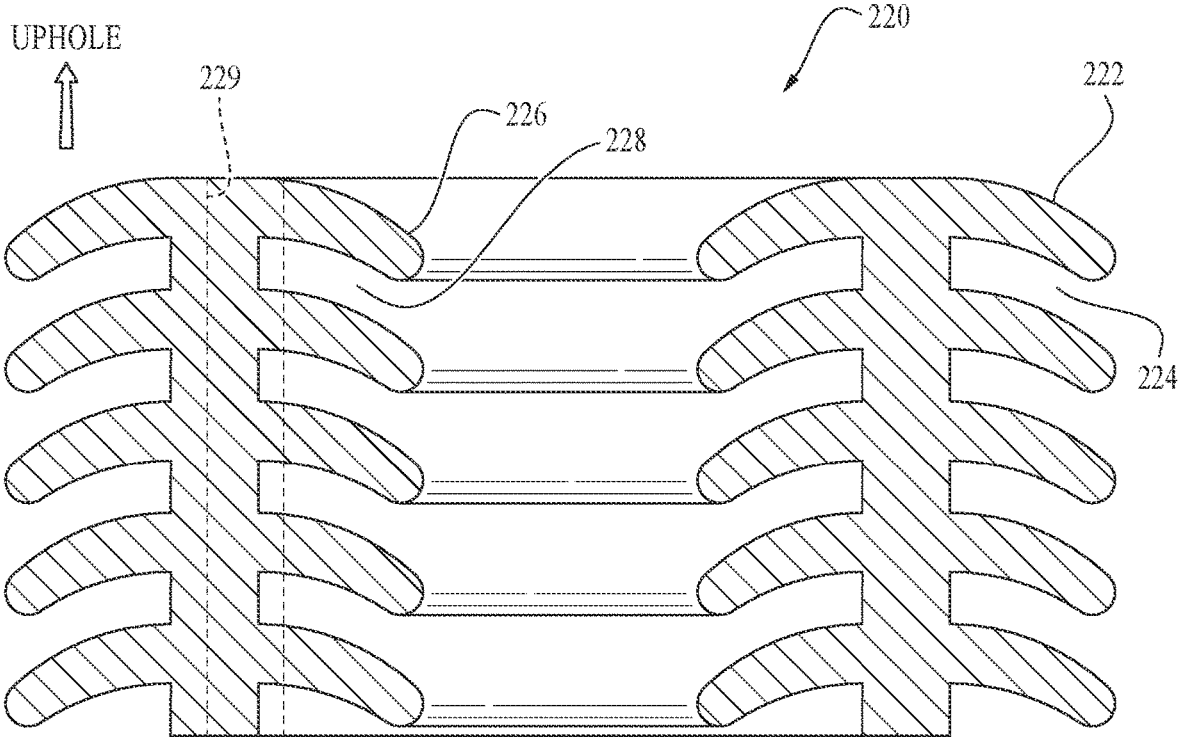
FIG. 6 is an illustration of yet another sacrificial anode body according to an embodiment of the disclosure.

Turning now to FIG. 6, another embodiment of a sacrificial anode body 220 is described. The sacrificial anode body 220 may be used in the containment 167 described above and is substantially similar to the sacrificial anode body 190 of FIG. 3 and FIG. 4, except that the cross-sectional geometry of the one or more grooves 224 and the one or more lands 222 on an outside of the sacrificial anode body 220 and the one or more grooves 228 and the one or more lands 226 on an inside of the sacrificial anode body 220 differ from those of grooves 194, 198 and lands 196, 199 of sacrificial anode body 190 described above. The lands 224, 228 and grooves 222, 226 of the sacrificial anode body 220 may promote debris generated by reaction of $H_2S$ gas with the material of the sacrificial anode body 220 more readily sloughing off of the lands 222, 226 and falling to the void area at the downhole end of the containment 167 surrounding the sacrificial anode body 220. The geometry of the grooves 224, 228 and lands 222, 226 may also promote avoiding the grooves 224, 228 becoming encumbered or obstructed by debris that does not slough off. In an embodiment, the sacrificial anode body 220 defines a bore 229 that receives the breather tube 162 which extends downhole inside of the bore 229. In an embodiment, the grooves 224 may define a helical flow pathway around an outside of the sacrificial anode body 220 and the grooves 228 may define a helical flow pathway around an inside of the sacrificial anode body 220. In some contexts, the lands 222 and the lands 226 may be said to define a chevron shape or an inverted V-shape in vertical cross section. In some contexts, the lands 222 may be said to define half of a chevron shape or half of an inverted V-shape in vertical cross section, and the lands 226 may be said to define another half of a chevron shape or another half of an inverted V-shape in vertical cross section. While shown as curved downwards at their outer edges, in another embodiment, the lands 222 may be straight and angled downwards towards their outer edges.

With reference now to FIG. 3, FIG. 4, FIG. 5, and FIG. 6, while the one or more lands and grooves of the sacrificial anode bodies 190, 210, 220 were illustrated as spaced an equal distance apart at different vertical positions (from uphole to downhole), the height of the lands and grooves (e.g., the spacing between the lands and grooves) may vary from an uphole to a downhole location, for example in accord as an $H_2S$ concentration or rate of flow may be expected to vary between an uphole and a downhole location within the sacrificial anode body 190, 210, 220. Additionally, the height of the lands and grooves may vary between the inside facing portion of the sacrificial anode bodies 190, 210, 220 and the outside facing portion of the sacrificial anode bodies 190, 210, 220, on the assumption that the H2S concentration or flow rate may be greater in the inside facing portion of the sacrificial anode bodies 190, 210, 220 than in the outside facing portion of the sacrificial anode bodies 190, 210, 220.

In some contexts, the sacrificial anode bodies 190, 210, 220 may be said to have a monolithic structure or a unitary structure. The radial depths of the grooves of any of the sacrificial anode bodies 190, 210, 220 may be at least one sixth of the diameter of the outside of the sacrificial anode body.

In an embodiment, the rate of twist of helically disposed grooves and lands of the sacrificial anode bodies 190, 210, 220 may vary between an inside and an outside of the sacrificial anode bodies 190, 210, 220; the rate of twist may vary between an uphole and a downhole position in the inside of the sacrificial anode bodies 190, 210, 220; and the rate of twist may vary between a downhole and an uphole position in the outside of the sacrificial anode bodies 190, 210, 220.

Figure 7:
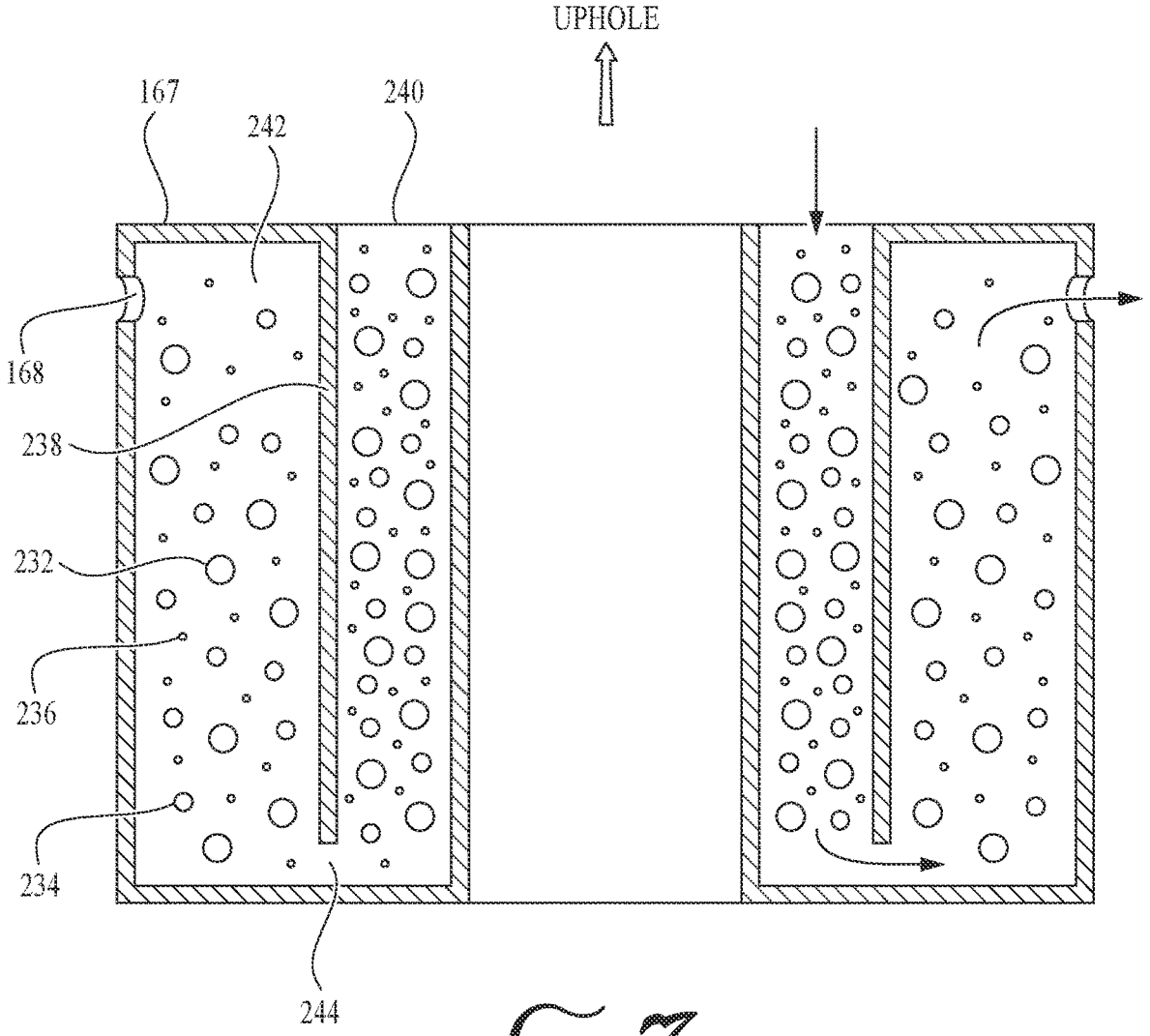
FIG. 7 is an illustration of a sacrificial anode assembly according to an embodiment of the disclosure.

Turning now to FIG. 7, another embodiment of a sacrificial anode assembly 230 is described. The sacrificial anode assembly 230 comprises containment 167, bulkhead 238, and sacrificial anode nodules 232, 234, 236. The bulkhead 238 may be formed substantially as a cylinder. The bottom of the bulkhead 238 does not reach the downhole end of the containment 167 and a gap 244 between the downhole end of the containment 167 and the downhole end of the bulkhead 238 define a flow path between an interior annulus 240 and an outer annulus 242 within the sacrificial anode assembly 230. The first sacrificial anode nodule 232 is a large-sized sphere-shaped or egg-shaped mass of sacrificial material, the second sacrificial anode nodule 234 is a medium-sized sphere-shaped or egg-shaped mass of sacrificial material, and the third sacrificial anode nodule 236 is a small-sized sphere-shaped or egg-shaped mass of sacrificial material. As with the other sacrificial anode bodies 190, 210, 220, the sacrificial material of the sacrificial anode nodules 232, 234, 236 may be copper, bronze, aluminum, zinc, or other sacrificial materials. In an embodiment, some of the sacrificial anode nodules 232, 234, 236 may be of one type of sacrificial material while others of the sacrificial anode nodules 232, 234, 236 may be a second type of sacrificial material. In an embodiment, some sacrificial anode nodules 232, 234, 236 are made of copper and other sacrificial anode nodules 232, 234, 236 are made of bronze. In an embodiment, some sacrificial anode nodules 232, 234, 236 are made of copper and other sacrificial anode nodules 232, 234, 236 are made of aluminum. In an embodiment, some sacrificial anode nodules 232, 234, 236 are made of copper and other sacrificial anode nodules 232, 234, 236 are made of zinc. In an embodiment, some sacrificial anode nodules 232, 234, 236 are made of bronze and other sacrificial anode nodules 232, 234, 236 are made of aluminum. In an embodiment, some sacrificial anode nodules 232, 234, 236 are made of bronze and other sacrificial anode nodules 232, 234, 236 are made of zinc. In an embodiment, some sacrificial anode nodules 232, 234, 236 are made of aluminum and other sacrificial anode nodules 232, 234, 236 are made of zinc.

In an embodiment, some sacrificial anode nodules 232, 234, 236 are made of copper, other sacrificial anode nodules 232, 234, 236 are made of bronze, and other sacrificial. anode nodules 232, 234, 236 are made of aluminum. In an embodiment, some sacrificial anode nodules 232, 234, 236 are made of copper, other sacrificial anode nodules 232, 234, 236 are made of bronze, and other sacrificial anode nodules 232, 234, 236 are made of zinc. In an embodiment, some sacrificial anode nodules 232, 234, 236 are made of bronze, other sacrificial anode nodules 232, 234, 236 are made of aluminum, and other sacrificial anode nodules 232, 234, 236 are made of zinc. In an embodiment, some sacrificial anode nodules 232, 234, 236 are made of copper, other sacrificial anode nodules 232, 234, 236 are made of bronze, other sacrificial. anode nodules 232, 234, 236 are made of aluminum, and other sacrificial anode nodules 232, 234, 236 are made of zinc.

While in FIG. 7 and in the description above, three different sizes of sacrificial anode nodules are described, in another embodiment, the sacrificial anode assembly 230 may comprise two different sizes of sacrificial anode nodules, four different sizes of sacrificial anode nodules, five different sizes of sacrificial anode nodules, six different sizes of sacrificial anode nodules, or more than six different sizes of sacrificial anode nodules and less than twenty different sizes of sacrificial anode nodules. The proportion of numbers of nodules of different sizes may be adapted to improve the performance of the sacrificial anode assembly 230 with reference to avoiding flow passages through the sacrificial anode nodules 232, 234, 236 becoming blocked by debris generated by reacting $H_2S$ gas with the sacrificial anode nodules 232, 234, 236. In an embodiment, the flow of fluid may be in at a top of the sacrificial anode assembly 230 into the inner annulus 240, downhole in the inner annulus 240, through the gap 244 at the downhole end of the bulkhead 238, uphole in the outside annulus 242, and out the ports 168 or in the reverse direction. This pathway of fluid first downhole in the inner annulus 240 within the sacrificial anode assembly 230 and then uphole in the outer annulus 242 within the sacrificial anode assembly 230 may be referred to as a folded flow path or a tortuous flow path.

While a single bulkhead 238 is illustrated in FIG. 7, it is understood that additional bulkheads may be included within the containment 167 to define additional annulus and gaps either at the top or bottom of the containment 167 to promote reversing direction of fluid flow within the sacrificial anode assembly 230 whereby to increase the tortuousness of the fluid flow path and increase the opportunities for H2S gas to react with the sacrificial anode nodules 232, 234, 236. Additionally, while FIG. 7 illustrates and the description of FIG. 7 describes sacrificial anode nodules that are spherical and/or egg-shaped in form, it is understood that in another embodiment the sacrificial anode nodules may take on other shapes, such as irregular shapes. In an embodiment, the sacrificial anode nodules may have irregular shapes that result from processing through a metal shredding operation during a recycling or salvage process.

With reference now to FIG. 1, FIG. 2, FIG. 3, FIG. 4, FIG. 5, FIG. 6, and FIG. 7, it is understood that the seal section 112 of the ESP assembly 106 may comprise any one of the embodiments of a sacrificial anode assembly 166, 180 described above or modifications of these sacrificial anode assemblies 166. As was mentioned above, the seal section 112 may comprise a plurality of expansion bladders and an associated sacrificial anode assembly 166, 180 disposed uphole of each expansion bladder. The sacrificial anode assemblies 166, 180 in a seal section 112 may be different embodiments. For example, the first sacrificial anode assembly 166 of FIG. 2 may be provided by the embodiment described with reference to FIG. 3, the second sacrificial anode assembly 180 of FIG. 2 may be provided by the embodiment described with reference to FIG. 5, a third sacrificial anode assembly may be provided by the embodiment described with reference to FIG. 6. Alternatively, one of these three different embodiments of the sacrificial anode assembly may be substituted by the embodiment described with reference to FIG. 7.

Different embodiments of the sacrificial anode assembly 166, 180 may be desired at different positions within the seal section 112 on the basis that the concentration or rate of infiltration of $H_2S$ gas may be different at each different position within the seal section 112. For example, the sacrificial anode assembly described with reference to FIG. 6 may be preferred near the uphole end of the seal section 112 where the H2S concentration and/or flow rate may be expected to be highest because the geometry of the sacrificial anode body 220 better promotes sloughing debris off of the lands 222, 226 and maintaining the flow passages provided by the grooves 224, 228 clear; the sacrificial anode assembly described with reference to FIG. 5 may be preferred in a middle position of the seal section 112 because its ability to slough debris off of lands 212, 216 is less than that of the sacrificial anode body 220 but better than that of the sacrificial anode body 190; and the sacrificial anode body 190 described with reference to FIG. 3 or the sacrificial anode assembly described with reference to FIG. 7 may be preferred in a downhole position of the seal section 112 because its ability to slough debris is less than either of the two upper sacrificial anode bodies 210, 220 but may provide other advantages, such as a more tortuous flow pathway or more mass of sacrificial material.

Figure 8:
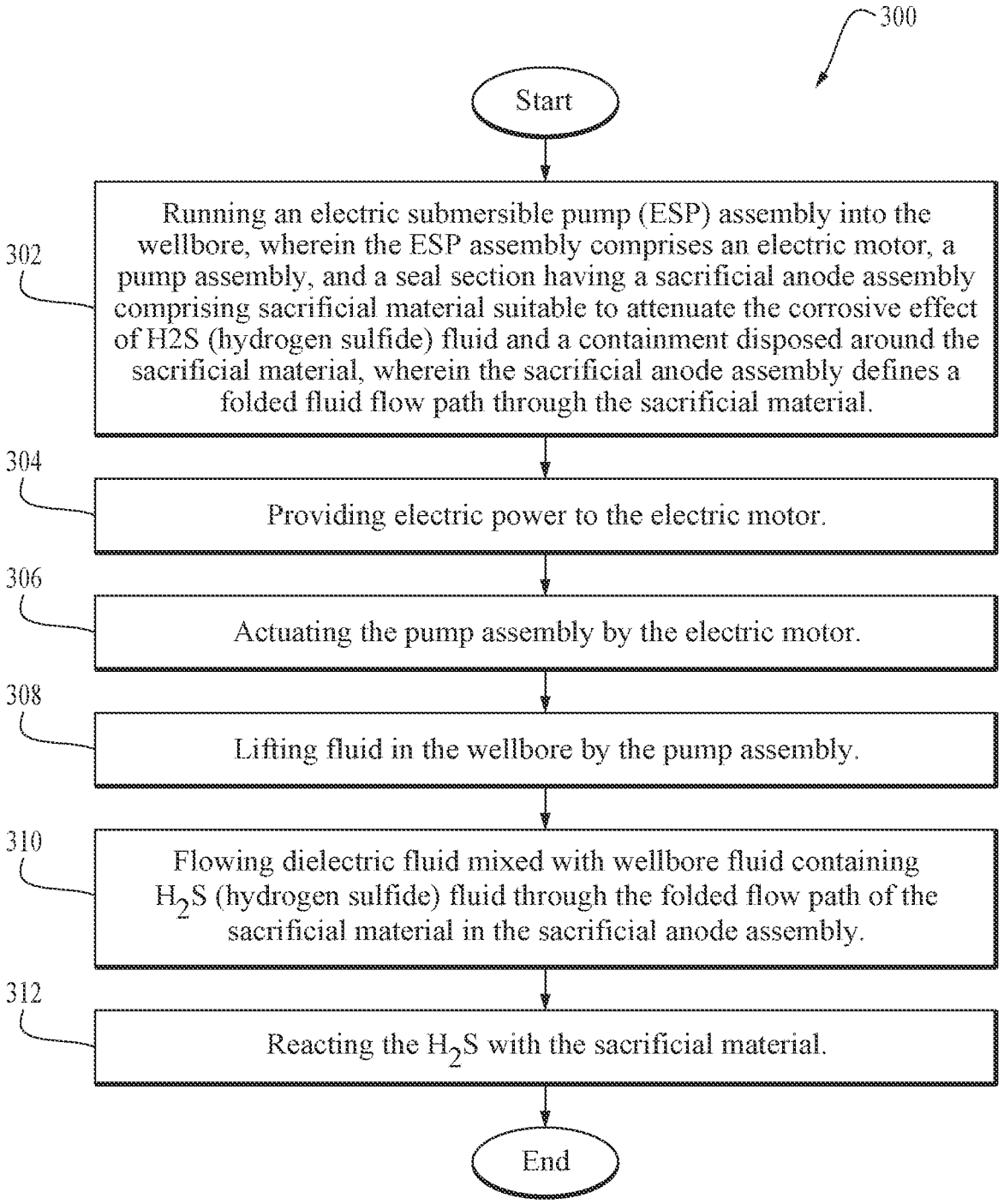
FIG. 8 is a flow chart of a method according to an embodiment of the disclosure.

Turning now to FIG. 8, a method 300 is described. In an embodiment, the method 300 is a method of lifting fluid in a wellbore. At block 302, the method 300 comprises running an electric submersible pump (ESP) assembly into the wellbore, wherein the ESP assembly comprises an electric motor, a pump assembly, and a seal section having a sacrificial anode assembly comprising sacrificial material suitable to attenuate the corrosive effect of $H_2S$ (hydrogen sulfide) fluid and a containment disposed around the sacrificial material, wherein the sacrificial anode assembly defines a folded fluid flow path through the sacrificial material. In an embodiment, the electric motor may be disposed downhole of the seal section, and the seal section may be disposed downhole of the pump assembly. In another embodiment, however, for example in a so-called "through tubing conveyed" (TTC) configuration, the pump may be disposed downhole of the seal section, and the seal section may be disposed downhole of the electric motor. In an embodiment, the ESP assembly further comprises a gas separator. In an embodiment, the ESP assembly may be assembled at a wellbore and run into the hole from a mast structure or from a wireline apparatus. In an embodiment, the sacrificial material is provided as a monolithic sacrificial anode body that defines lands and grooves. In an embodiment, the lands and grooves define a helical fluid flow path within the sacrificial anode assembly.

At block 304, the method 300 comprises providing electric power to the electric motor. Electric power may be provided to the electric motor via an electric power cable that extends from a power source at the surface down through the wellbore to the electric motor. The electric power cable may be secured at multiple points to a production tubing that connects to the ESP assembly. The electric power may be provided to the electric cable by an electric power conditioning source at the surface, for example by a variable frequency drive (VFD). At block 306, the method 300 comprises actuating the pump assembly by the electric motor. Actuating the pump assembly may comprise the electric motor turning a drive shaft of the electric motor, the drive shaft of the electric motor turning a drive shaft of the seal section, and the drive shaft of the seal section turning a drive shaft of the pump assembly. In an embodiment, a gas separator may be disposed proximate to the pump assembly, and a drive shaft of the gas separator may turn the drive shaft of the pump assembly (in which case the drive shaft of the gas separator may be turned by the drive shaft of the seal section) or the drive shaft of the pump assembly may turn the drive shaft of the gas separator (in a TTC configuration wherein the gas separator may be disposed downhole of the pump assembly).

At block 308, the method 300 comprises lifting fluid in the wellbore by the pump assembly. The fluid may be well fluid. The fluid may comprise various hydrocarbons and/or salt water. The fluid may comprise $H_2S$, in gas phase, in liquid phase, or in both phases. The fluid may comprise hot water, for example in a geothermal application. At block 310, the method 300 comprises flowing dielectric fluid mixed with wellbore fluid containing $H_2S$ (hydrogen sulfide) fluid through the folded flow path of the sacrificial material in the sacrificial anode assembly. The $H_2S$ fluid may gradually infiltrate or diffuse into the dielectric fluid over time from the wellbore. The $H_2S$ fluid may be able to pass through elastomer materials of expansion bladders of the seal section and continue to infiltrate the seal section towards the electric motor. The fluid may be lifted in the production tubing by the pump assembly to the surface and produced at the surface, for example flowing into a pipeline disposed at the surface or flowing into a tank battery at the surface for settling and separation of salt water, liquid phase hydrocarbons, and gas phase hydrocarbons.

At block 312, the method 300 comprises reacting the $H_2S$ with the sacrificial material. The sacrificial material may be disposed inside of a sacrificial anode assembly comprising the sacrificial material and a containment. The sacrificial material may be a metal having a more negative electrochemical potential (e.g., a more highly active metal) than average. In an embodiment, the sacrificial material may be copper, bronze, aluminum, zinc, or a blend of two or more of these. In the presence of $H_2S$, the sacrificial material reacts with the $H_2S$ to neutralize or disassociate the $H_2S$. In this process of reacting the $H_2S$ gas with the sacrificial material, the sacrificial material itself is progressively consumed by corrosion and may disintegrate into debris particles or chunks (e.g., the more mass of $H_2S$ gas that is reacted and neutralized, the more the sacrificial material corrodes and disintegrates). In an embodiment, the ESP assembly comprises a plurality of sacrificial anode assemblies, and the processing of block 312 comprises reacting $H_2S$ gas at any one or more of this plurality of sacrificial anode assemblies.

In an embodiment, the method 300 further comprises sloughing off a plurality of debris particles off the sacrificial material (e.g., as $H_2S$ gas reacts with the sacrificial material and disintegrates the sacrificial material) and capturing the plurality of debris particles in a void area at a downhole end of the containment.

ADDITIONAL EMBODIMENTS

The following are non-limiting, specific embodiments in accordance with the present disclosure:

A first embodiment, which is a seal section for use with an electric motor in a downhole wellbore environment comprising a drive shaft, a housing, and at least one sacrificial anode assembly that comprises a sacrificial anode body configured to attenuate the corrosive effect of $H_2S$ (hydrogen sulfide) fluid and a containment disposed inside the housing, defining an annulus between an outside of the containment and an inside of the housing, disposed around the sacrificial anode body, defining interiorly an initially void space downhole of the sacrificial anode body, and disposed around the drive shaft, wherein the sacrificial anode assembly defines two ports open to an interior of the seal section, wherein the two ports are disposed in an uphole half of the sacrificial anode assembly, and wherein the sacrificial anode assembly defines a folded fluid flow path between the two ports through the sacrificial anode body.

A second embodiment, which is the seal section of the first embodiment wherein the sacrificial anode comprises a plurality of sacrificial anode nodules.

A third embodiment, which is the seal section of the second embodiment wherein the sacrificial anode nodules comprise nodules that are of a first size, nodules of a second size that are larger than the first size, and nodules of a third size that are larger than the second size.

A fourth embodiment, which is the seal section of the first embodiment, wherein the sacrificial anode body is a monolithic structure.

A fifth embodiment, which is the seal section of the fourth embodiment, wherein the sacrificial anode body defines a plurality of lands and grooves.

A sixth embodiment, which is the seal section of any of the first through the fifth embodiment, wherein at least ninety percent and no more than one hundred percent of the mass of the sacrificial anode body is copper, bronze, aluminum, zinc, or a combination of these.

A seventh embodiment, which is the seal section of any of the first through the fifth embodiment, wherein at least ninety-five percent and no more than one hundred percent of the mass of the sacrificial anode body is copper, bronze, aluminum, zinc, or a combination of these metals.

An eighth embodiment, which is the seal section of any of the first through the fifth embodiment, wherein at least ninety-seven percent and no more than one hundred percent of the mass of the sacrificial anode body is copper, bronze, aluminum, zinc, or a combination of these metals.

A ninth embodiment, which is the seal section of any of the first through the fifth embodiment, wherein at least ninety-eight percent and no more than one hundred percent of the mass of the sacrificial anode body is copper, bronze, aluminum, zinc, or a combination of these metals.

A tenth embodiment, which is the seal section of any of the first through the fifth embodiment, wherein at least ninety-nine percent and no more than one hundred percent of the mass of the sacrificial anode body is copper, bronze, aluminum, zinc, or a combination of these metals.

An eleventh embodiment, which is the seal section of any of the first through the fifth embodiment, wherein one hundred percent of the mass of the sacrificial anode body is copper, bronze, aluminum, zinc, or a combination of these metals.

A twelfth embodiment, which is the seal section of any one of the first embodiment or the fourth through the eleventh embodiment, wherein the sacrificial anode body is a monolithic structure that defines a plurality of lands and grooves and wherein at least some of the lands and grooves are helically disposed about an outside of the sacrificial anode body.

A thirteenth embodiment, which is the seal section of the twelfth embodiment, wherein some of the lands and grooves are disposed about an inside of the sacrificial anode body.

A fourteenth embodiment, which is the seal section of any of the first through the thirteenth embodiment, wherein the seal section further comprises an expansion bladder disposed downhole of the sacrificial anode assembly.

A fourteenth embodiment, which is the seal section of any of the first through the thirteenth embodiment, wherein the seal section comprises a plurality of sacrificial anode assemblies.

A fifteenth embodiment, which is the seal section of the fourteenth embodiment, wherein the seal section comprises a plurality of expansion bladders equal in number to the number of sacrificial anode assemblies and wherein each expansion bladder is separated from the other expansion bladder by one of the sacrificial anode assemblies.

A sixteenth embodiment, which is an electric submersible pump (ESP) assembly comprising an electric motor having a first drive shaft; a seal section coupled to the electric motor and comprising a second drive shaft that is coupled to the first drive shaft, a housing, and at least one sacrificial anode assembly that comprises a sacrificial anode body configured to attenuate the corrosive effect of $H_2S$ (hydrogen sulfide) fluid and a containment disposed inside the housing, defining an annulus between an outside of the containment and an inside of the housing, disposed around the sacrificial anode body, defining interiorly an initially void space downhole of the sacrificial anode body, and disposed around the second drive shaft, wherein the sacrificial anode assembly defines two ports open to an interior of the seal section, wherein the two ports are disposed in an uphole half of the sacrificial anode assembly, and wherein the sacrificial anode assembly defines a folded fluid flow path between the two ports through the sacrificial anode body; and a pump assembly having a third drive shaft that is coupled directly to the second drive shaft or coupled indirectly to the second drive shaft by one or more intermediate drive shafts.

A seventeenth embodiment, which is the ESP assembly of the sixteenth embodiment, wherein the sacrificial anode body comprises a plurality of sacrificial anode nodules or is a monolithic structure.

An eighteenth embodiment, which is the ESP assembly of the sixteenth or the seventeenth embodiment, wherein the sacrificial anode body is a monolithic structure.

A nineteenth embodiment, which is the ESP assembly of any of the sixteenth through the eighteenth embodiment, wherein at least ninety percent and no more than one hundred percent of the mass of the sacrificial anode body is copper, bronze, aluminum, zinc, or a combination of these.

A twentieth embodiment, which is the ESP assembly of any of the sixteenth through the eighteenth embodiment, wherein at least ninety-five percent and no more than one hundred percent of the mass of the sacrificial anode body is copper, bronze, aluminum, zinc, or a combination of these.

A twenty-first embodiment, which is the ESP assembly of any of the sixteenth through the eighteenth embodiment, wherein at least ninety-seven percent and no more than one hundred percent of the mass of the sacrificial anode body is copper, bronze, aluminum, zinc, or a combination of these.

A twenty-second embodiment, which is the ESP assembly of any of the sixteenth through the eighteenth embodiment, wherein at least ninety-eight percent and no more than one hundred percent of the mass of the sacrificial anode body is copper, bronze, aluminum, zinc, or a combination of these.

A twenty-third embodiment, which is the ESP assembly of any of the sixteenth through the eighteenth embodiment, wherein at least ninety-nine percent and no more than one hundred percent of the mass of the sacrificial anode body is copper, bronze, aluminum, zinc, or a combination of these.

A twenty-fourth embodiment, which is the ESP assembly of any of the sixteenth through the eighteenth embodiment, wherein one hundred percent of the mass of the sacrificial anode body is copper, bronze, aluminum, zinc, or a combination of these.

A twenty-fifth embodiment, which is the ESP assembly of any of the sixteenth through the twenty-fourth embodiment, wherein the sacrificial anode body is a monolithic structure and defines one or more lands and one or more grooves.

A twenty-sixth embodiment, which is the ESP assembly of the twenty-fifth embodiment, wherein at least some of one or more the lands and grooves are helically disposed about an outside of the sacrificial anode body.

A twenty-seventh embodiment, which is the ESP assembly of the twenty-sixth embodiment, wherein some of the one or more lands and grooves are disposed about an inside of the sacrificial anode body.

A twenty-eighth embodiment, which is the ESP assembly of any of the sixteenth through the twenty-seventh embodiment, wherein the seal section comprises an expansion bladder downhole of the sacrificial anode assembly.

A twenty-ninth embodiment, which is the ESP assembly of any of the sixteenth through the twenty-seventh embodiment, wherein the seal section comprises a plurality of sacrificial anode assemblies.

A thirtieth embodiment, which is the ESP assembly of any of the twenty-ninth embodiment, wherein the seal section comprises a plurality of expansion bladders wherein the number of expansion bladders is equal to the number of sacrificial anode assemblies.

A thirty-first embodiment, which is the ESP assembly of any of the sixteenth, the seventeenth, the nineteenth through the twenty-fourth, or the twenty-eight through the thirtieth embodiment, wherein the sacrificial anode body comprises a plurality of sacrificial anode nodules, wherein the containment comprises at least one cylindrical bulkhead that separates a first annular portion of the sacrificial anode assembly retaining sacrificial anode nodules from a second annular portion of the sacrificial anode assembly retaining sacrificial anode nodules.

A thirty-second embodiment, which is an electric submersible pump (ESP) assembly comprising a seal section coupled to an electric motor of the ESP assembly, wherein the seal section comprises a housing and at least one sacrificial anode assembly, wherein the at least one sacrificial anode assembly comprises a sacrificial anode body suitable to attenuate the corrosive effect of $H_2S$ (hydrogen sulfide) fluid, wherein the sacrificial anode body has a monolithic structure and a containment disposed inside the housing, defining an annulus between an outside of the containment and an inside of the housing, disposed around the sacrificial anode body, defining interiorly an initially void space downhole of the sacrificial anode body, wherein the sacrificial anode assembly defines a folded fluid flow path through the sacrificial anode body.

A thirty-third embodiment, which is the ESP assembly of the thirty-second embodiment, wherein the ESP assembly has a through tubing conveyed (TTC) configuration.

A thirty-fourth embodiment, which is the ESP assembly of the thirty-second or the thirty-third embodiment, wherein the containment defines a first port at an uphole end of the containment and a plurality of second ports in upper portion of an outside cylindrical wall of the containment, and wherein the folded fluid flow path is a bidirectional path consisting of (1) fluid flowing in the first port, downhole inside of the containment through a first portion of the sacrificial anode body, uphole inside the containment through a second portion of the sacrificial anode body, and out the plurality of second ports and (2) fluid flowing in the plurality of second ports, downhole inside of the containment through the second portion of the sacrificial anode body, uphole inside the containment through the first portion of the sacrificial anode body, and out the first port.

A thirty-fifth embodiment, which is the ESP assembly of any of the thirty-second through the thirty-fourth embodiment, wherein the sacrificial anode body defines one or more grooves and lands in a radially outwards portion of the sacrificial anode body.

A thirty-sixth embodiment, which is the ESP assembly of the thirty-fifth embodiment, wherein the one or more grooves and lands are helically disposed around the radially outwards portion of the sacrificial anode body.

A thirty-seventh embodiment, which is the ESP assembly of any of the thirty-second through the thirty-sixth embodiment, wherein the sacrificial anode body defines one or more grooves and lands in a radially inwards portion of the sacrificial anode body.

A thirty-eighth embodiment, which is the ESP assembly of the thirty-seventh embodiment, wherein the one or more grooves and lands in the radially inwards portion of the sacrificial anode body are helically disposed around the radially inwards portion of the sacrificial anode body.

A thirty-ninth embodiment, which is the ESP assembly of any of the thirty-fifth through the thirty-eighth embodiment wherein the radial depth of the one or more grooves is at least one sixth of the diameter of the outside of the sacrificial anode body.

A fortieth embodiment, which is the ESP assembly of any of the thirty-fifth through the thirty-ninth embodiment, wherein the one or more lands define a sawtooth shape in vertical cross-section, a chevron shape in vertical cross-section, or a rectangular shape in vertical cross-section.

A forty-first embodiment, which is a method of lifting fluid in a wellbore, comprising running an electric submersible pump (ESP) assembly into the wellbore, wherein the ESP assembly is according to any of the sixteenth through the thirty-first embodiment; providing electric power to the electric motor; actuating the pump assembly by the electric motor; lifting fluid in the wellbore by the pump assembly; flowing dielectric fluid mixed with wellbore fluid containing $H_2S$ (hydrogen sulfide) fluid through the folded flow path of the sacrificial material in the sacrificial anode assembly; and reacting the $H_2S$ with the sacrificial material.

A forty-second embodiment, which is a method of lifting fluid in a wellbore comprising running an electric submersible pump (ESP) assembly into the wellbore, wherein the ESP assembly comprises an electric motor, a pump assembly, and a seal section having a sacrificial anode assembly comprising sacrificial material suitable to attenuate the corrosive effect of $H_2S$ (hydrogen sulfide) fluid and a containment disposed around the sacrificial material, wherein the sacrificial anode assembly defines a folded fluid flow path through the sacrificial material; providing electric power to the electric motor; actuating the pump assembly by the electric motor; lifting fluid in the wellbore by the pump assembly; flowing dielectric fluid mixed with wellbore fluid containing $H_2S$ (hydrogen sulfide) fluid through the folded flow path of the sacrificial material in the sacrificial anode assembly; and reacting the $H_2S$ with the sacrificial material.

A forty-third embodiment, which is the method of the forty-second embodiment, further comprising sloughing a plurality of debris particles off the sacrificial material; and capturing the plurality of debris particles in a void area at a downhole end of the containment.

A forty-fourth embodiment, which is the method of any of the forty-second or the forty-third embodiment, wherein the sacrificial material is provided as a monolithic sacrificial anode body that defines one or more lands and grooves.

A forty-fifth embodiment, which is the method of the forty-fourth embodiment, wherein the one or more lands and grooves define a helical fluid flow path within the sacrificial anode assembly.

A forth-sixth embodiment, which is the method of the forty-fourth embodiment, wherein the one or more lands and grooves define a tortuous fluid flow path within the sacrificial anode assembly.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. An electric submersible pump (ESP) assembly, comprising:

an electric motor having a first drive shaft;

a seal section coupled to the electric motor and comprising a second drive shaft that is coupled to the first drive shaft, a housing, and at least one sacrificial anode assembly that comprises a sacrificial anode body configured to attenuate the corrosive effect of $H_2S$ (hydrogen sulfide) fluid and a containment disposed inside the housing, defining an interior chamber between an outside of the containment and an inside of the housing, defining an annulus disposed around the sacrificial anode body, defining interiorly an initially void space downhole of the sacrificial anode body, and disposed around the second drive shaft, wherein the sacrificial anode assembly defines two ports open to the interior chamber of the seal section, wherein the two ports are disposed in an uphole half of the sacrificial anode assembly, and wherein the sacrificial anode assembly defines a folded fluid flow path between the two ports through the sacrificial anode body; and a pump assembly having a third drive shaft that is coupled directly to the second drive shaft or coupled indirectly to the second drive shaft by one or more intermediate drive shafts.

2. The ESP assembly of claim 1, wherein the sacrificial anode body comprises a plurality of sacrificial anode nodules or a monolithic structure.

3. The ESP assembly of claim 1, wherein at least ninety percent of the mass of the sacrificial anode body is copper, bronze, aluminum, zinc, or a combination of these.

4. The ESP assembly of claim 1, wherein the sacrificial anode body is a monolithic structure and defines one or more lands and grooves.

5. The ESP assembly of claim 4, wherein at least some of the one or more lands and grooves are helically disposed about an outside of the sacrificial anode body.

6. The ESP assembly of claim 5, wherein some of the one or more lands and grooves are disposed about an inside of the sacrificial anode body.

7. The ESP assembly of claim 1, wherein the seal section comprises a plurality of sacrificial anode assemblies.

8. The ESP assembly of claim 1, wherein the sacrificial anode body comprises a plurality of sacrificial anode nodules, wherein the containment comprises at least one cylindrical bulkhead that separates a first annular portion of the sacrificial anode assembly retaining sacrificial anode nodules from a second annular portion of the sacrificial anode assembly retaining sacrificial anode nodules.

9. An electric submersible pump (ESP) assembly, comprising:

a seal section coupled to an electric motor of the ESP assembly, wherein the seal section comprises a housing and at least one sacrificial anode assembly, wherein the at least one sacrificial anode assembly comprises a sacrificial anode body suitable to attenuate the corrosive effect of $H_2S$ (hydrogen sulfide) fluid, wherein the sacrificial anode body has a monolithic structure and a containment disposed inside the housing, defining an interior chamber between an outside of the containment and an inside of the housing, defining an annulus disposed around the sacrificial anode body, defining interiorly an initially void space downhole of the sacrificial anode body, wherein the sacrificial anode assembly defines a folded fluid flow path through the sacrificial anode body.

10. The ESP assembly of claim 9, wherein the ESP assembly has a through tubing conveyed (TTC) configuration.

11. The ESP assembly of claim 9, wherein the containment defines a first port at an uphole end of the containment and a plurality of second ports in upper portion of an outside cylindrical wall of the containment, and wherein the folded fluid flow path is a bidirectional path consisting of (1) fluid flowing in the first port, downhole inside of the containment through a first portion of the sacrificial anode body, uphole inside the containment through a second portion of the sacrificial anode body, and out the plurality of second ports and (2) fluid flowing in the plurality of second ports, downhole inside of the containment through the second portion of the sacrificial anode body, uphole inside the containment through the first portion of the sacrificial anode body, and out the first port.

12. The ESP assembly of claim 9, wherein the sacrificial anode body defines a plurality of grooves and lands in a radially outwards portion of the sacrificial anode body.

13. The ESP assembly of claim 12, wherein the grooves and lands are helically disposed around the radially outwards portion of the sacrificial anode body.

14. The ESP assembly of claim 12, wherein the sacrificial anode body defines one or more grooves and lands in a radially inwards portion of the sacrificial anode body.

15. The ESP assembly of claim 14, wherein a radial depth of the one or more grooves is at least one sixth of the diameter of the outside of the sacrificial anode body.

16. The ESP assembly of claim 12, wherein the one or more lands define a sawtooth shape in vertical cross-section, a chevron shape in vertical cross-section, or a rectangular shape in vertical cross-section.

* * * * *